United States Patent [19]

Dellinger

[11] 4,386,665

[45] Jun. 7, 1983

[54] DRILLING TECHNIQUE FOR PROVIDING MULTIPLE-PASS PENETRATION OF A MINERAL-BEARING FORMATION

[75] Inventor: Thomas B. Dellinger, Duncanville, Tex.

[73] Assignee: Mobil Oil Corporation, New York, N.Y.

[21] Appl. No.: 315,394

[22] Filed: Oct. 27, 1981

Related U.S. Application Data

[63] Continuation of Ser. No. 111,751, Jan. 14, 1980, abandoned, which is a continuation of Ser. No. 906,905, May 18, 1978, abandoned.

[51] Int. Cl.[3] ..... E21B 7/06

[52] U.S. Cl. ..... 175/61; 166/50

[58] Field of Search ..... 175/61, 62; 166/50, 166/272

[56] References Cited

U.S. PATENT DOCUMENTS 2,280,851 4/1942 Ranney ..... 175/61
2,404,341 7/1946 Zublin ..... 175/61
2,565,794 8/1961 Young ..... 175/61
3,986,557 10/1976 Striegler ..... 166/272

*Primary Examiner*—William F. Pate, III
*Attorney, Agent, or Firm*—C. A. Huggett; M. G. Gilman; J. F. Powers, Jr.

[57] ABSTRACT

This specification discloses a technique of providing a wellbore that is extended along a track from the surface of the earth and penetrates and passes through a subsurface mineral-bearing formation a plurality of times. The wellbore is initially extended from the surface of the earth into the earth's crust in essentially a vertical direction and then is deviated toward the horizontal and extended to pass through the subsurface mineral-bearing formation from top to bottom at an oblique angle. The wellbore is then further deviated and extended along a track in an upwardly direction such that it again penetrates and passes through the subsurface mineral-bearing formation, this time from bottom to top. The wellbore may then again be deviated and extended along a downward track to again penetrate the formation from the top.

4 Claims, 1 Drawing Figure

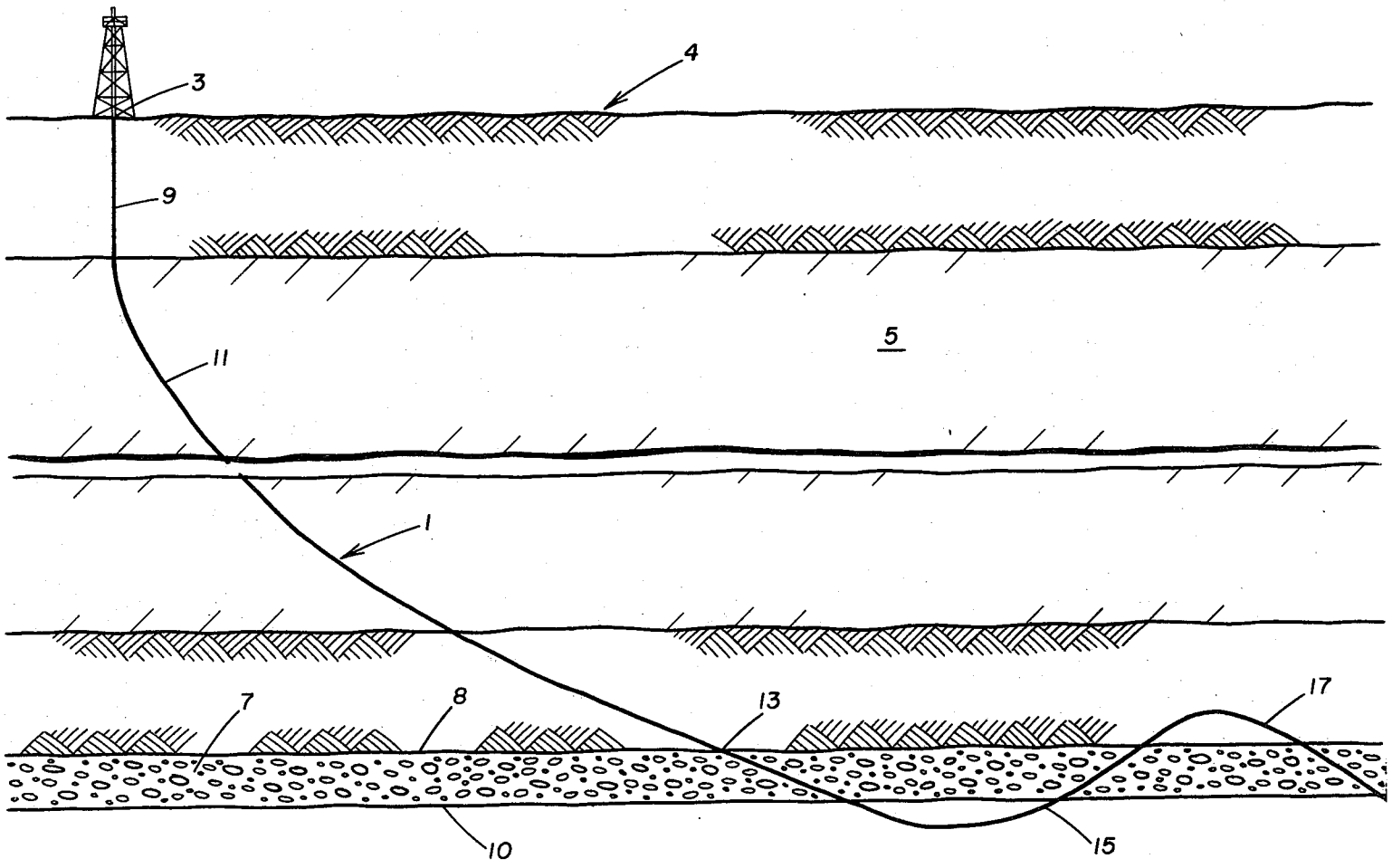
17
15
5
13
4
10
8
1
7
11
3
9

DRILLING TECHNIQUE FOR PROVIDING MULTIPLE-PASS PENETRATION OF A MINERAL-BEARING FORMATION

CROSS-REFERENCE TO RELATED APPLICATIONS

This application is a continuation of application Ser. No. 111,751, filed Jan. 14, 1980, which is a continuation of application Ser. No. 906,905, filed May 18, 1978 both abandoned.

BACKGROUND OF THE INVENTION

This invention is concerned with a technique of providing a wellbore that extends from a surface location of the earth into the earth's crust and passes through a subsurface mineral-bearing formation a plurality of times. More particularly, this invention concerns providing a deviated wellbore which extends along a track in a downwardly direction and penetrates a subsurface mineral-bearing formation from top to bottom. The wellbore is then further deviated and extended along a track in an upwardly direction to again penetrate the formation from bottom to top. This sequence may be repeated to provide further penetrations by the wellbore of the formation.

Wellbores and wells have been extended into the earth in directions other than vertical for various reasons and by various techniques. A need for such wells was early recognized and still exists today for tapping mineral reserves located beneath water bodies or located beneath other poorly accessible surface locations. For example, before the turn of the century the Summerland Field located underwater near Santa Barbara, Calif. was drilled by whipstocking holes out under the water from land locations.

More recent developments have enabled ultrahigh-angle wellbores to be drilled and completed. "Extended reach drilling" is a term that has been coined to describe rotary drilling procedures used to drill wellbores greater than 60° from the vertical and the use of complex wellbore profiles to extend the horizontal limits of wellbores.

In an article entitled "Ultrahigh-Angle Wells Are Technical and Economic Success", THE OIL AND GAS JOURNAL, July 19, 1976, pp. 115–120, there is described a project wherein a well was drilled and completed to 12,300-foot measured depth at an average angle of 82° . In a paper, SPE 6818, "Improved Techniques for Logging High-Angle Wells" by M. W. Bratovitch, W. T. Bell, and K. D. Kaaz, which was presented at the 52nd Fall Technical Conference and Exhibition of the Society of Petroleum Engineers of AIME in Denver, Colo., Oct. 9–12, 1977, it is said that high-angle wells are becoming commonplace, particularly in offshore areas. The paper describes work which contributes to increasing the deviation angles at which wells can be conventionally logged and to deciding whether to try gravity-descent or pump-down tools as a first attempt at logging high-angle wells.

In U.S. Pat. No. 3,285,350 to J. K. Henderson, there is described a technique for drilling off-vertical holes through earth formations and more particularly a technique and apparatus for controllably drilling holes through and substantially parallel to mineral formations between separated wells. A method and apparatus is described for lining wellbores such as bores extending laterally or generally horizontally from a main bore into a surrounding formation in U.S. Pat. No. 2,778,603 to McCune et al.

In U.S. Pat. No. 3,933,447 to Joseph Pasini III et al, there is described a method for the gasification of coal in situ. In one aspect there described, a borehole is drilled from the earth's surface, preferably on a slant so as to intersect the coal bed while traveling in a horizontal direction. Using this technique it was found that major advantages are achieved over the use of vertical wells or blind boreholes. In U.S. Pat. Nos. 3,986,557 and 4,007,788 both to Striegler et al, there are described methods of producing bitumen from subterranean tar sand formations which methods employ a continuous wellbore having a second section thereof contained within the formation and a first and third section extending from said second section to the earth's surface.

A method for removing methane gas from underground coal beds by means of a borehole is described in U.S. Pat. No. 3,934,649 to Joseph Pasini III et al. A borehole is provided that extends through the coal bed in a horizontal direction. In U.S. Pat. No. 4,003,440 to Martin D. Cherrington there is described a method and apparatus for extending a borehole in an inverted arcuate path underneath an obstacle such as a watercourse.

In a copending application U.S. Ser. No. 892,794, filed Apr. 3, 1978, to Joseph U. Messenger, there is described a technique of providing a wellbore that extends from a surface location to a subsurface location spaced a great lateral distance therefrom in a mineral-bearing formation wherein a portion of the wellbore extends a great distance within and essentially parallel to the bedding plane of a formation having good drilling characteristics. The formation having good drilling characteristics may be located above or below the mineral-bearing formation as may be the mineral-bearing formation itself.

SUMMARY OF THE INVENTION

This invention is directed to a method of providing a wellbore that extends from a surface location of the earth into the earth's crust and communicates with a subsurface mineral-bearing formation. There is formed a first portion of the wellbore to extend essentially vertically from the surface location into the earth's crust. A second portion of the wellbore is formed that is deviated from the vertical and extends from the lower end of the first portion into the upper boundary of the subsurface formation and through the subsurface formation and into the earth's crust there below. Thereafter a third portion of the wellbore is formed that extends from the lower end of the second portion and is deviated and extended in an upwardly direction into the subsurface formation from the lower boundary thereof.

BRIEF DESCRIPTION OF THE DRAWING

The drawing is a schematic view illustrating a wellbore track provided in accordance with the method of this invention.

DESCRIPTION OF THE PREFERRED EMBODIMENTS

This invention is directed to a technique of providing a wellbore that extends from a surface location of the earth and communicates with a mineral-bearing subsurface formation by passing through the formation a plurality of times. The multiple passes of the wellbore through the mineral-bearing formation provides increased communication of the formation with the wellbore over that obtained by conventionally drilled wellbores which pass through the formation only once.

This invention is particularly applicable for recovering hydrocarbons from a hydrocarbon-bearing formation and will be described primarily with regard thereto though it is also applicable for recovering minerals from other mineral-bearing formations. A deviated wellbore is provided as hereafter described to penetrate a hydrocarbon-bearing formation a plurality of times along a continuous portion of the formation. The deviated wellbore penetrates and passes through the formation from the upper side thereof and is then further deviated and extended in an upwardly direction to penetrate the formation from the lower boundary thereof. The wellbore may be extended through the formation and the sequence repeated to provide additional passes of the wellbore through the formation. The wellbore may thereafter be completed to provide a well for the recovery of hydrocarbons therefrom.

The present invention is directed to a technique of providing a wellbore that penetrates a hydrocarbon-bearing formation a plurality of times. The wellbore may be completed and cased as desired to provide a well for producing the hydrocarbons from the formation. The penetration of the formation a plurality of times provides increased communication of the well with the formation which enables the hydrocarbons to be produced therefrom at an increased rate while at the same time provides for less pressure drop across the completed intervals thereby lessening sand production problems. The wellbore of this invention may be completed in at least two spaced apart intervals in the hydrocarbon-bearing formation, thus lessening the drainage radius in at least part of the formation and providing more complete recovery from that part of the formation in a given period of time over that offered by a well which penetrates the formation only once.

For a more detailed description of the invention reference is made to the drawing where there is shown schematically the track of a wellbore 1 that extends from a surface location 3 of the earth's surface 4 into the earth's crust 5 and penetrates a subsurface mineral-bearing formation 7, such as a hydrocarbon-bearing formation, a plurality of times. The wellbore 1 has a first portion 9 which extends essentially vertically from the surface location 3 into the earth's crust 5. This first portion 9 of the wellbore could, if desired, be provided to extend into the earth's crust along a slant direction rather than essentially vertically but normally will be extended essentially vertically therein. After initiating the wellbore and providing the first portion 9 thereof, the wellbore is deviated and a second portion 11 is provided which extends through the earth's crust 5 and to a subsurface location 13 along the upper boundary 8 of the hydrocarbon-bearing formation 7. This second portion 11 of the wellbore is extended through the formation 7 and thereafter the wellbore is deviated and a third portion 15 is provided which extends along an upward track and penetrates the formation 7 from the lower boundary 10 thereof. This third portion may be extended to pass through the formation 7 and the wellbore 1 may again be deviated to provide a fourth portion 17 which extends along a downward tract and penetrates the formation 7 along the upper boundary 8 thereof. This sequence may be repeated to provide for additional passes of the wellbore through the formation 7.

In carrying out this invention, it is desirable that the second portion 11 of the wellbore 1 be deviated to form a track that makes an angle within the range of about 60° to 80° with the vertical prior to passing into the mineral-bearing formation 7. This lessens the extent to which this second portion 13 must be extended below the formation 7 in order to facilitate the next deviation and provide the next portion 15 of the wellbore which extends upward into the formation 7. Likewise it is desirable to deviate the wellbore and provide for the portion 15 to pass upward and through the formation 7 at an angle within the range of 60° to 80° from the vertical. The passing of the wellbore through the formation 7 at an angle of 60° to 80° with the verticle in addition to facilitating the deviation of the next portion thereof provides for a low-angle pass of the wellbore through the formation which provides for increased communication of the wellbore with the formation.

What is claimed is:

1. A method of providing a wellbore that extends from a surface location of the earth into the earth's crust and communicates with a subsurface hydrocarbon-bearing formation comprising:

(a) forming a first portion of said wellbore to extend essentially vertically from said surface location into said earth's crust;

(b) forming a second portion of said wellbore that is deviated from said first portion and extends from the lower end of said first portion through the upper boundary of said subsurface hydrocarbon-bearing formation, through said hydrocarbon-bearing formation and into the earth's crust therebelow, said second portion of said wellbore upon passing said upper boundary of said hydrocarbon-bearing formation making an angle with the verticle within the range of 60° to 80° ;

(c) forming a third portion of said wellbore that extends from the lower end of said second portion and is deviated and extended in an upwardly direction through the lower boundary of said hydrocarbon-bearing formation and into said hydrocarbon-bearing formation, and (d) completing and casing said wellbore to provide a well of producing hydrocarbons from said hydrocarbon bearing formation to the surface of the earth.

2. The method of claim 1 wherein said third portion of said wellbore upon passing said lower boundary of said hydrocarbon-bearing formation makes an angle with the vertical within the range of 60° to 80° .

3. The method of claim 2 further comprising:

(a) extending said third portion of said wellbore through said hydrocarbon-bearing formation and into the earth's crust above said hydrocarbon-bearing formation; and (b) forming a fourth portion of said wellbore that extends from the end of said third portion and is deviated and extended in a downwardly direction through said upper boundary of said hydrocarbon-bearing formation and into said subsurface formation.

4. The method of claim 3 wherein said fourth portion of said wellbore upon passing said upper boundary makes an angle with the vertical within the range of 60° to 80°.

* * * * *